US007063209B2

(12) United States Patent
Chen

(10) Patent No.: US 7,063,209 B2
(45) Date of Patent: Jun. 20, 2006

(54) MEMO BLOCK BASE AND CONTAINER WITH MAGNETIC SUSPENSION DEVICE

(75) Inventor: Liang-Ji Chen, Tainan (TW)

(73) Assignee: Dashern Enterprise Co., Ltd., Tainan (TW)

( * ) Notice: Subject to any disclaimer, the term of this patent is extended or adjusted under 35 U.S.C. 154(b) by 266 days.

(21) Appl. No.: 10/761,259

(22) Filed: Jan. 22, 2004

(65) Prior Publication Data

US 2005/0161360 A1 Jul. 28, 2005

(51) Int. Cl.
*B65H 1/04* (2006.01)

(52) U.S. Cl. ..... 206/449; 206/181; 312/61; 221/59; 221/60

(58) Field of Classification Search ..... 221/56, 221/59, 60, 33, 45, 46, 58, 197, 198; 312/61; 206/449, 39, 812, 818, 425, 215, 557
See application file for complete search history.

(56) References Cited

U.S. PATENT DOCUMENTS

| | | | | | |
|---|---|---|---|---|---|
| 3,425,595 | A * | 2/1969 | Shapira | 221/52 |
| 3,826,406 | A * | 7/1974 | Moniot | 221/58 |
| 3,953,090 | A * | 4/1976 | Fuchs | 312/183 |
| 4,966,305 | A * | 10/1990 | Hinterreiter | 221/229 |
| 5,417,345 | A * | 5/1995 | Smith | 221/33 |
| 6,098,794 | A * | 8/2000 | Lin | 206/217 |
| 6,267,263 | B1 * | 7/2001 | Emoff et al. | 221/45 |

* cited by examiner

*Primary Examiner*—Mickey Yu
*Assistant Examiner*—Jerrold Johnson
(74) *Attorney, Agent, or Firm*—Rosenberg, Klein & Lee

(57) ABSTRACT

A memo block base and container is composed by a memo block base and a container. The memo block base is provided with at least one magnetic article in the bottom, the container is provided with at least one magnetic article in the inner bottom, and the upward pole of the magnetic article in the container is the same as the downward pole of the magnetic article in the memo block base. When the memo block base is placed in the container, the memo block base will keep suspending and away a certain distance from the inner bottom of the container because of the effect of magnetic suspension.

3 Claims, 6 Drawing Sheets

MEMO BLOCK BASE AND CONTAINER WITH MAGNETIC SUSPENSION DEVICE

BACKGROUND OF THE INVENTION

1. Field of the Invention

The present invention relates to a memo block base and container with innovatory new features, and more particularly to a memo block base and container that is provided with magnetic suspension device, so as to achieve the convenient, solid, vivid and interesting effects.

2. Description of the Related Art

Memo blocks are widely used by people of all walks of life to make a pen or pencil notation on the upper sheet at any time. Therefore, memo blocks are indispensible in modern life.

Referring to FIG. 1, a conventional memo block 10 is composed by a pile of straight and regularly cut notepapers, one side surface of the memo block 10 may be glued to form a spine, so as for a user to open and look over the memo block 10, and a container 20 is provided to hold the memo block 10 in the right position. While being facilitated, referring to FIG. 2, an upper notepaper is torn and removed from the opening 201 of the container 20 for a user to make a pen or pencil notation thereon.

However, it is harder for a user to remove the notepapers near the bottom out of the opening 201 of the container 20 as the notepapers become less. Moreover, the outlook of the conventional memo block 10 and container 20 looks dull and plain.

SUMMARY OF THE INVENTION

Accordingly, the present invention is directed to a memo block base and container with magnetic suspension device that can substantially obviates the defects of the related conventional memo block and container.

An object of the present invention is to provide a memo block base and container with magnetic suspension device that the memo block base will keep suspending and away a certain distance from the inner bottom of the container when the memo block base is placed in the container, convenient for a user to remove the notepapers near the bottom.

Another object of the present invention is to provide a memo block base and container with magnetic suspension device that is vivid and interesting.

To achieve these advantages, a memo block base and container in the present invention is composed by a memo block base and a container. The memo block base is provided with at least one magnetic article in the bottom, the container is provided with at least one magnetic article in the inner bottom, and the upward pole of the magnetic article in the container is the same as the downward pole of the magnetic article in the memo block base. When the memo block base is placed in the container, the memo block base will keep suspending and away a certain distance from the inner bottom of the container because of the effect of magnetic suspension.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 1:
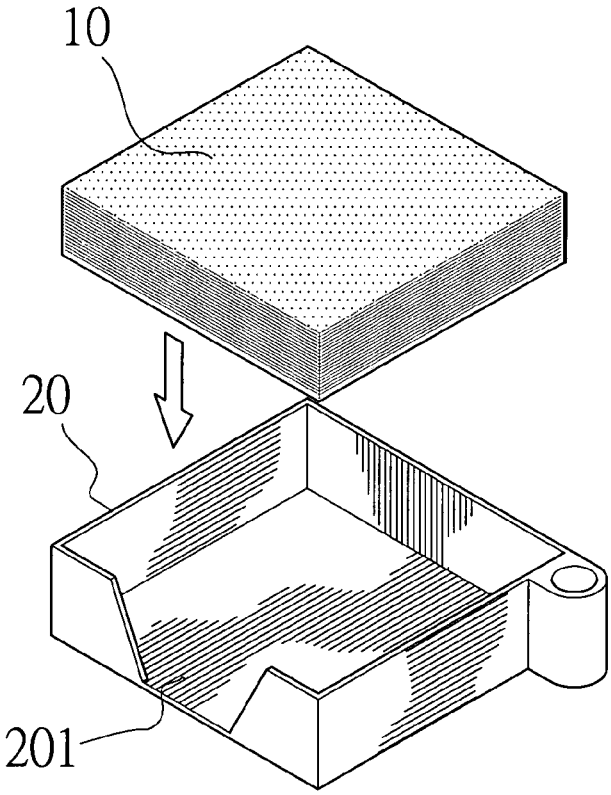
FIG-1 (PRIOR ART)
FIG. 1 is a perspective exploded view of a conventional memo block and container.
Figure 2:
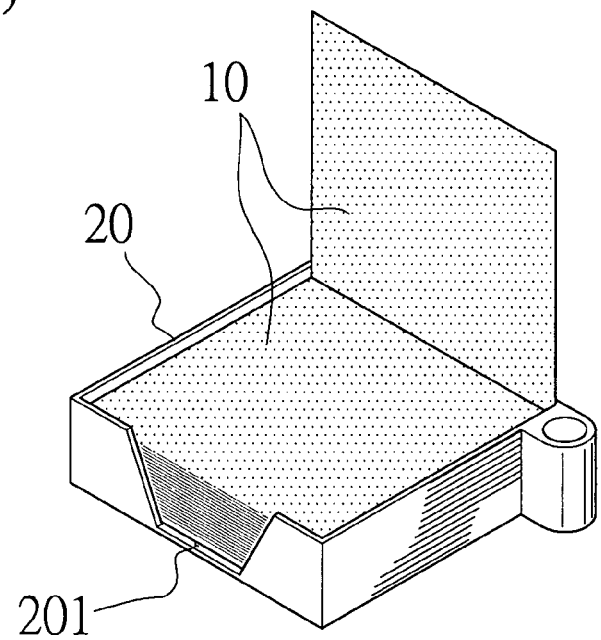
FIG-2 (PRIOR ART)
FIG. 2 is a perspective view of a conventional memo block and container in assembled configuration.
Figure 3:
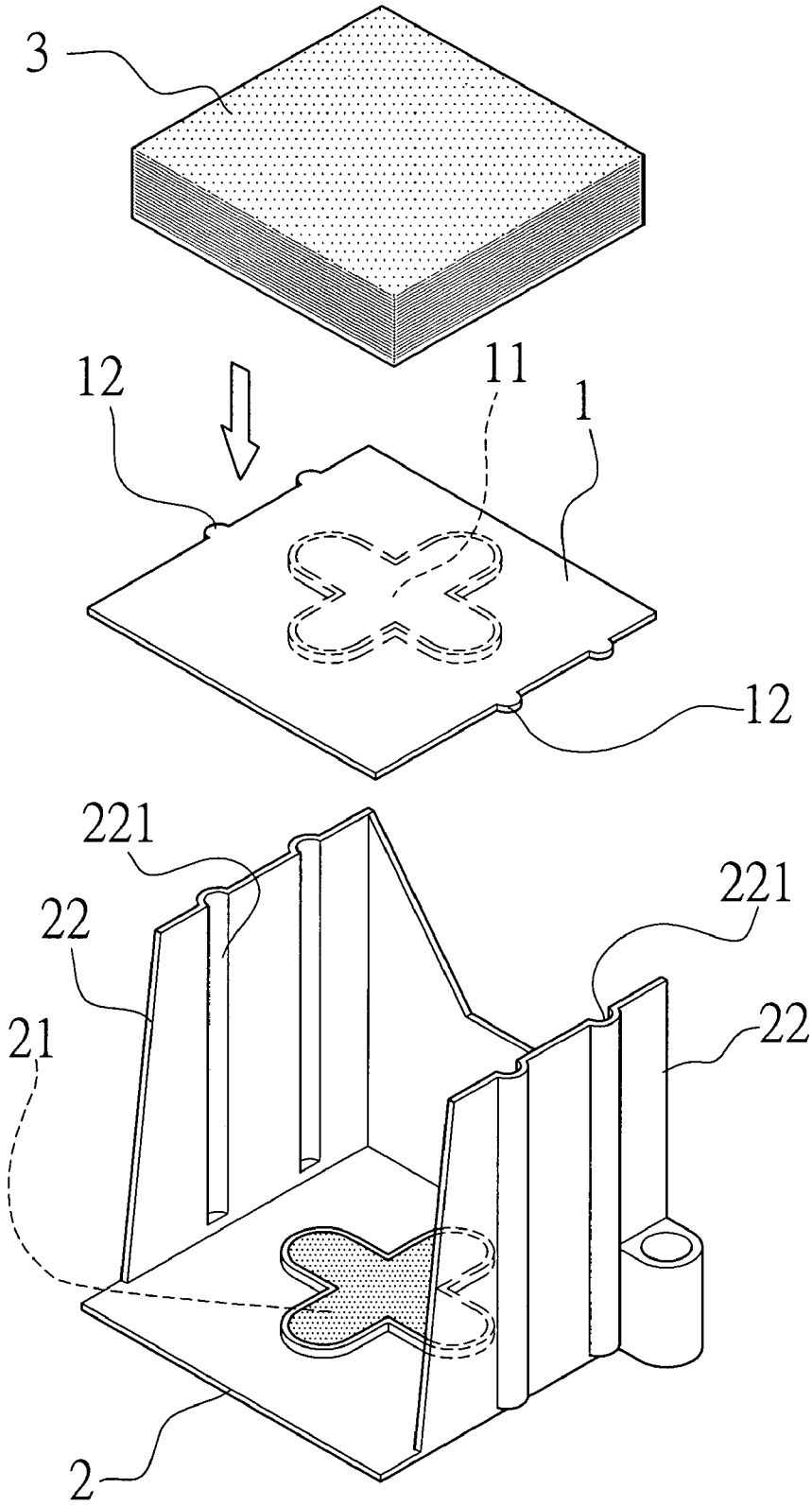
FIG. 3 is a perspective exploded view of an embodiment of the memo block base and container in accordance with the present invention.
Figure 5:
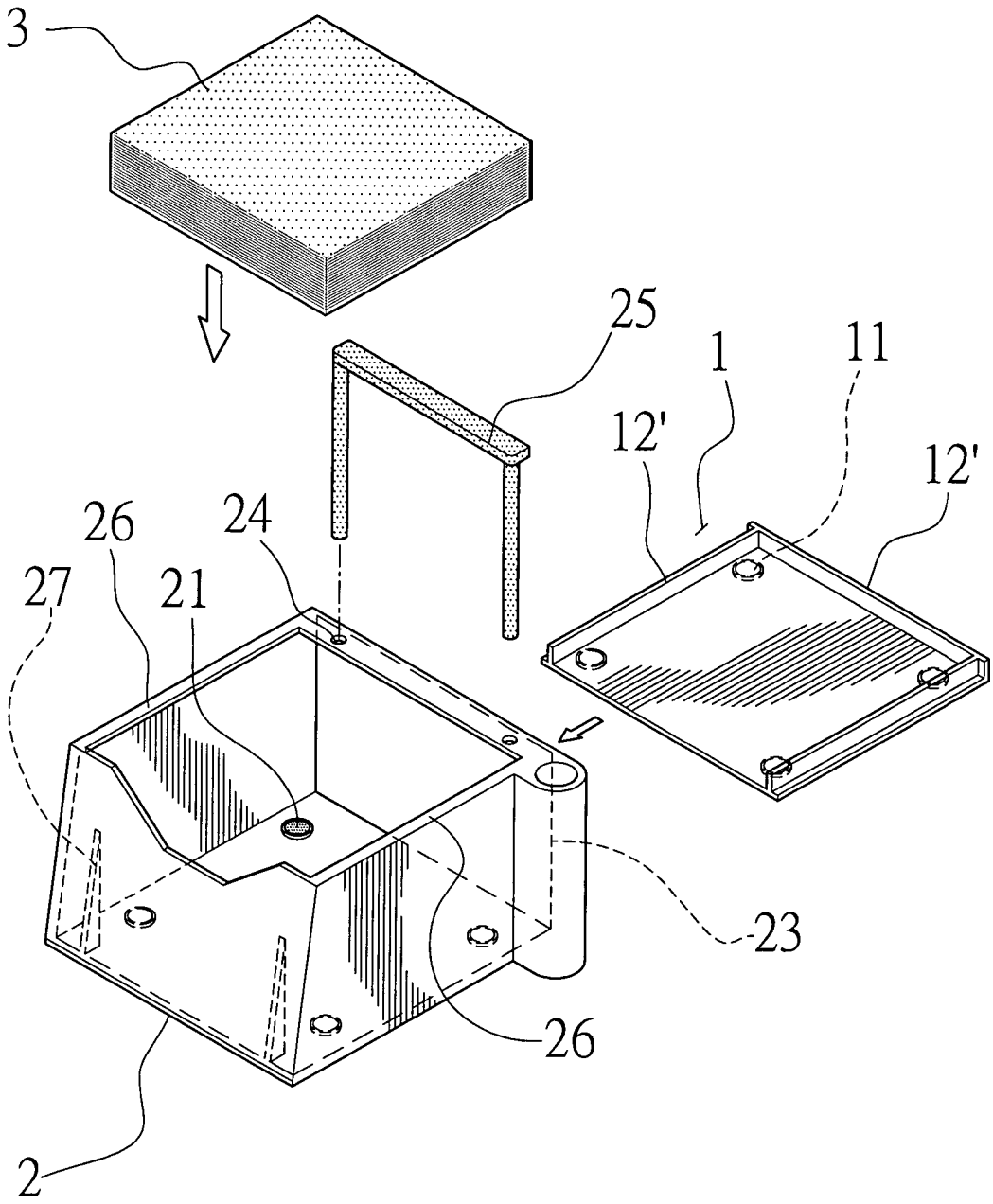
FIG. 5 is a perspective exploded view of another embodiment of the memo block base and container in accordance with the present invention.

Referring to FIG. 3, an embodiment of the memo block base and container with magnetic suspension device is composed by a memo block base 1 and a container 2. The memo block base 1 is provided for a memo block 3 to be placed thereon or glued to secure to the bottom of the memo block 3. The memo block base 1 is provided with at least one strong magnetic article 11 in the bottom, and flanges 12 or position-fixing members 12', referring to FIG. 5, are provided at the sides of the memo block base 1.

The container 2 is provided with at least one strong magnetic article 21 in the inner bottom, and the upward pole of the magnetic article 21 in the container 2 is the same as the downward pole of the magnetic article 11 in the memo block base 1. Flanged portions 22 are provided at the side walls of the container 2, and a sliding groove 221 is provided in each flanged portion 22. Alternatively, referring to FIG. 5, an opening 23 is provided in the rear of the container 2, through holes 24 are provided in the rear top end of the container 2 for a positioning article 25 to penetrate therethrough, a positioning portion 26 is respectively provided at the top ends of the right and left side walls of the container 2, and a pair of opposite positioning blocks 27 are provided on the inner surface of the front wall of the container 2.

Figure 4:
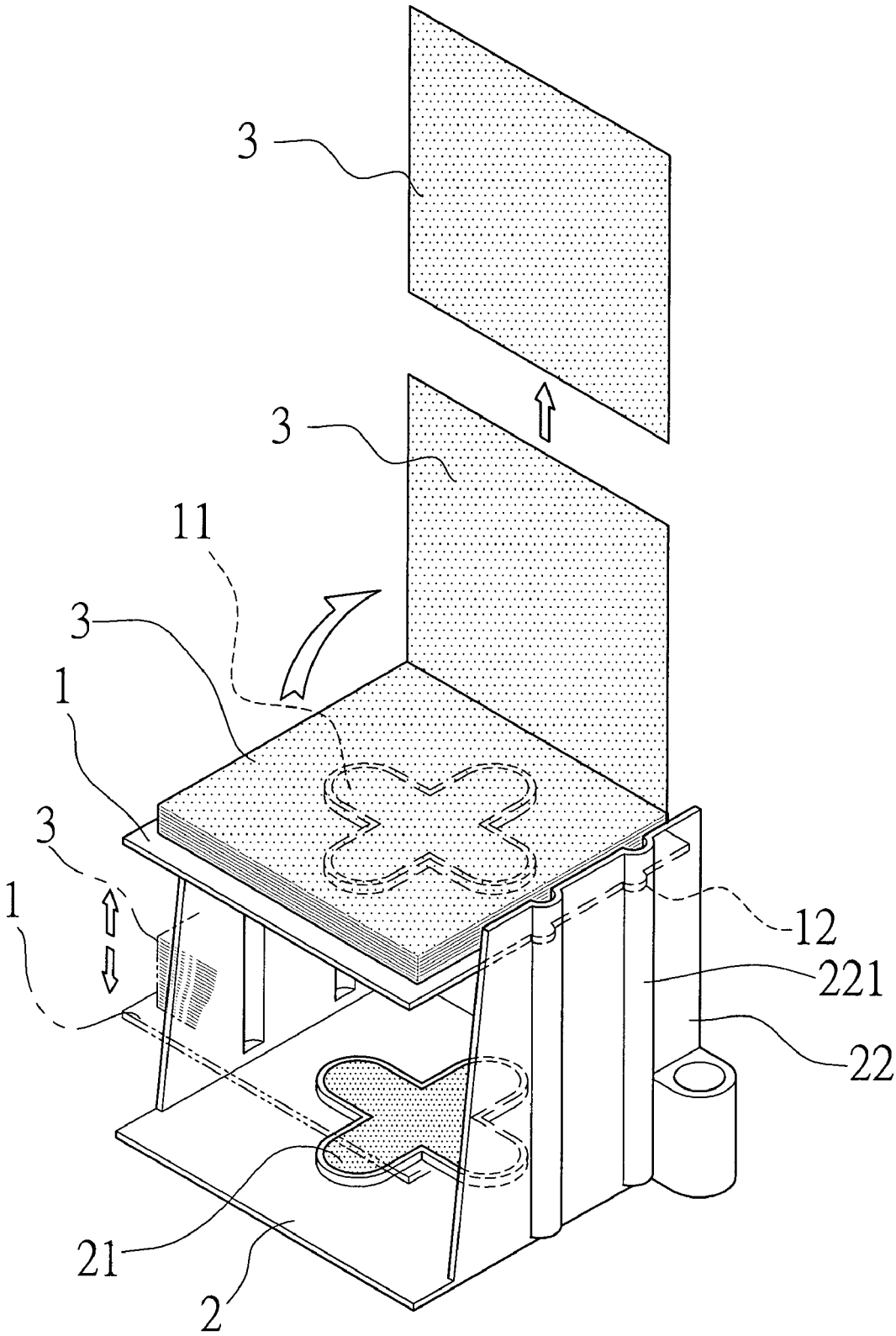
FIG. 4 is a perspective schematic view of an embodiment of the memo block base and container in an assembled configuration in accordance with the present invention while being facilitated.

While being assembled, referring to FIG. 4, the memo block 3 is placed or glued on the memo block base 1, then the memo block base 1 together with the memo block 3 is placed in the container 2, so as for the flanges 12 to move up and down respectively along the sliding grooves 221, and the memo block base 1 will keep suspending and away a certain distance from the inner bottom of the container 2 because the upward pole of the magnetic article 21 in the container 2 is the same as the downward pole of the magnetic article 11 in the memo block base 1.

While being facilitated, the upper sheet of the memo block 3 on the memo block base 1 is torn and removed for use, when the notepapers become less and less, the memo block base 1 with the thinner memo block 3 becomes lighter and will still keep suspending and away a certain distance from the inner bottom of the container 2, convenient for a user to remove the rest notepapers, and it looks vivid and interesting.

Figure 6:
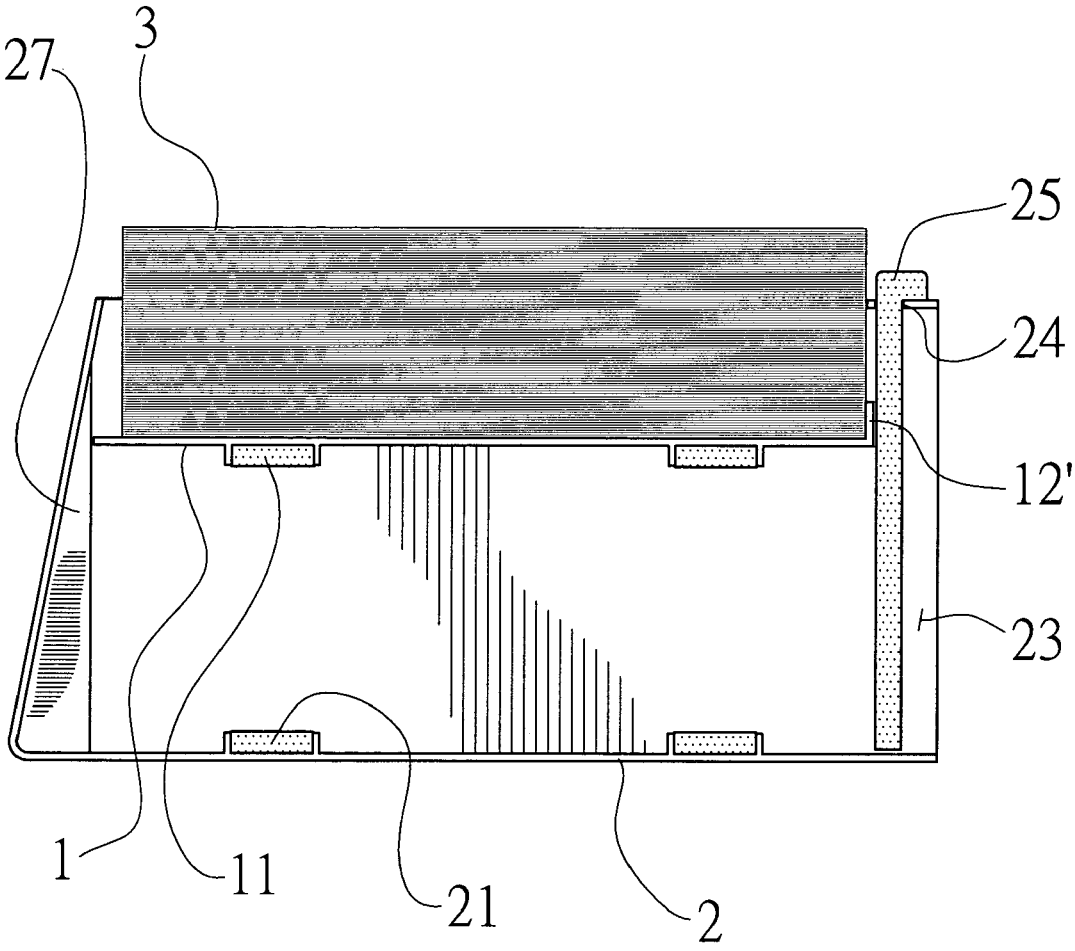
FIG. 6 is a cross-sectional view of another embodiment of the memo block base and container in assembled configuration in accordance with the present invention.
Figure 7:
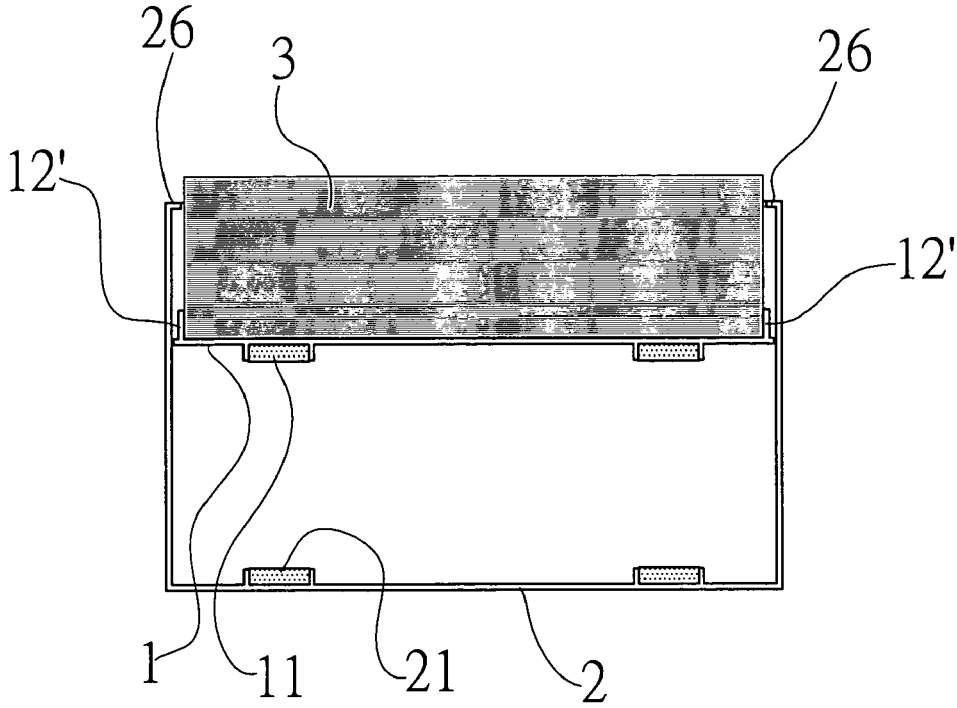
FIG. 7 is a front view of another embodiment of the memo block base and container in assembled configuration in accordance with the present invention; and, FIG. 8 is a further front view of another embodiment of the memo block base and container in assembled configuration in accordance with the present invention.
Figure 8:
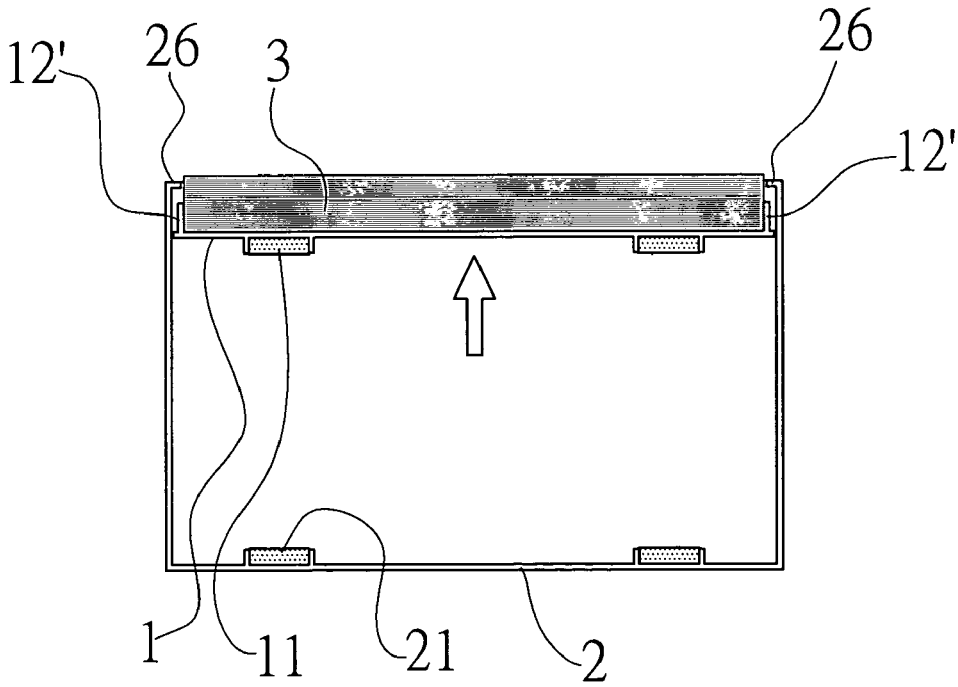

Referring to FIG. 5, while another preferred embodiment of the memo block base and container with magnetic suspension device being assembled, the memo block 3 is placed or glued on the memo block base 1, then the memo block base 1 together with the memo block 3 is placed through the rear opening 23 into the container 2, the positioning article 25 is secured to the container 2 by inserting its feet into the through holes 24 to prevent the memo block base 1 from moving out of the opening 23, and, at the same time, the memo block base 1 together with the memo block 3 will keep suspending and away a certain distance from the inner bottom of the container 2 because the upward pole of each magnetic article 21 in the container 2 is the same as the downward pole of each magnetic article 11 in the memo block base 1. The positioning portions 26 at the top ends of the right and left side walls of the container 2 and the pair of opposite positioning blocks 27 on the inner surface of the front wall of the container 2 can effectively hold the memo block base 1 in position in the container 2, referring to FIGS. 6, 7 and 8.

While the preferred embodiments of the invention have been described above, it will be recognized and understood that various modifications may be made thereto and the appended claims are intended to cover all such modifications which may fall within the spirit and scope of the invention.

What is claimed is:

1. A memo block base and container with magnetic suspension device comprising:

a memo block base being provided for holding a memo block, said memo block base being provided with at least one first magnetic article disposed on a bottom of said memo block base, said memo block base having a plurality protrusions extending from opposing sides thereof; and, a container being provided for holding said memo block base therein, said container having a pair of upstanding sidewalls extending from a bottom wall and being joined by a rear wall, the container having an open frontal area defined by the absence of a front wall in the area extending between said pair of sidewalls, said sidewalls having a plurality of sliding grooves formed therein and extending between respective top and bottom portions thereof for respectively receiving said plurality of protrusions of memo block base therein to guide movement of said memo block base within the entire range of movement of the memo block base within said container, said container being provided with at least one second magnetic article on an inner surface of said bottom wall, said second magnetic article having an upwardly facing pole being the same as a downwardly facing pole of said first magnetic article to provide a repulsive force therebetween.

2. The memo block base and container with magnetic suspension device, as recited in claim 1, wherein said memo block base is placed at a bottom of a memo block or fixed to the bottom of the memo block.

3. A memo block base and container with magnetic suspension device, comprising:

a memo block base being provided for holding a memo block, said memo block base being provided with at least one first magnetic article disposed on a bottom of said memo block base;

a container having a cavity formed therein for holding said memo block base therein, said cavity being defined between a pair of upstanding sidewalls extending from a bottom wall and a front wall joining said pair of sidewalls, said front wall having a pair of positioning blocks directed into said cavity and extending upwardly from adjacent said bottom wall, said cavity being open to a rear area of said container extending between said pair of sidewalls, said container having a positioning flange extending along a top of said pair of sidewalls and said rear area for restricting an upper extent of the memo block base within said cavity, the positioning flange having a pair of through holes formed therein in open communication with said cavity, the container being provided with at least one second magnetic article on an inner surface of said bottom wall, said second magnetic article having an upwardly facing pole being the same as a downwardly facing pole of said first magnetic article to provide a repulsive force therebetween; and a positioning article having a central member and a pair of feet respectively extending from opposing ends of said central member, said pair of feet respectively passing through said through holes of said positioning flange to penetrate into said cavity and thereby retain said memo block base in said cavity and together with said pair of positioning blocks providing a guide for said memo block base.

* * * * *